US009437992B2

(12) United States Patent
Matsumae et al.

(10) Patent No.: US 9,437,992 B2
(45) Date of Patent: Sep. 6, 2016

(54) BUSBAR

(71) Applicant: KAYABA INDUSTRY CO., LTD., Tokyo (JP)

(72) Inventors: Taroh Matsumae, Kanagawa (JP); Yuki Nagai, Kanagawa (JP)

(73) Assignee: KYB Corporation, Tokyo (JP)

( * ) Notice: Subject to any disclaimer, the term of this patent is extended or adjusted under 35 U.S.C. 154(b) by 74 days.

(21) Appl. No.: 14/372,854

(22) PCT Filed: Jan. 16, 2013

(86) PCT No.: PCT/JP2013/050600
§ 371 (c)(1),
(2) Date: Jul. 17, 2014

(87) PCT Pub. No.: WO2013/111640
PCT Pub. Date: Aug. 1, 2013

(65) Prior Publication Data

US 2015/0022952 A1 Jan. 22, 2015

(30) Foreign Application Priority Data

Jan. 26, 2012 (JP) ..... 2012-013883

(51) Int. Cl.
*H01R 27/02* (2006.01)
*H01R 12/70* (2011.01)
*H01R 12/72* (2011.01)

(52) U.S. Cl.
CPC ..... *H01R 27/02* (2013.01); *H01R 12/7047* (2013.01); *H01R 12/725* (2013.01)

(58) Field of Classification Search
CPC H01R 12/714; H01R 12/724; H01R 12/725; H01R 12/7047; H01R 12/7052; H01R 27/02
USPC ..... 361/760, 755, 638, 640; 439/83, 571, 439/572
See application file for complete search history.

(56) References Cited

U.S. PATENT DOCUMENTS

| | | | | |
|---|---|---|---|---|
| 6,162,091 | A | 12/2000 | Kurotori et al. | |
| 6,275,389 | B1 | 8/2001 | Huang et al. | |
| 6,659,796 | B1 | 12/2003 | Waddell et al. | |
| 7,189,081 | B2 * | 3/2007 | Tanaka | B60R 16/0238 439/76.2 |
| 2006/0099836 | A1 * | 5/2006 | Ho | H01R 12/725 439/74 |
| 2008/0194141 | A1 | 8/2008 | Wu et al. | |
| 2008/0318451 | A1 | 12/2008 | Lu et al. | |

FOREIGN PATENT DOCUMENTS

| | | | |
|---|---|---|---|
| CN | 201041894 | Y | 3/2008 |
| CN | 201075426 | Y | 6/2008 |
| JP | 06-276648 | A | 9/1994 |
| JP | 2003-079026 | A | 3/2003 |
| JP | 2010-035304 | A | 2/2010 |
| JP | 2011-254647 | A | 12/2011 |

OTHER PUBLICATIONS

Extended European Search Report dated Sep. 2, 2015.

* cited by examiner

*Primary Examiner* — Tuan T Dinh
*Assistant Examiner* — Mukund G Patel
(74) *Attorney, Agent, or Firm* — Rabin & Berdo, P.C.

(57) ABSTRACT

Disclosed is a busbar mounted on a board and electrically connected to an external element other than the board, including: a base portion; and a conductive pin body protruding from the base portion, wherein the base portion has a fixing portion where a fixing member for fixing the board and the base portion to each other is locked, and an engagement portion that extends from the fixing portion and is engaged with the board.

3 Claims, 6 Drawing Sheets

BUSBAR

TECHNICAL FIELD

The present invention relates to a busbar mounted on a board for electrical connection.

BACKGROUND ART

In an electronic circuit board, a metallic busbar is mounted between the board in order to transmit and receive electric power or signals between the boards. As a method of connecting the busbar between the boards in this manner, JP 2010-35304 A discusses a surface-mount busbar in which an end of the busbar is soldered to a surface of the board. For mounting a plurality of busbars simultaneously, a plurality of busbars are integrated using an insulating resin or the like.

SUMMARY OF INVENTION

When a module of the busbars integrated using a resin mold is mounted on a board, typically, a resin leg is provided for preventing the busbar from toppling.

In this case, there is a constraint when the busbars are positioned on the board in order to dispose the resin leg on the board. If the resin leg is not provided, a separate tool is necessary in a work of mounting the busbars on the board, which degrades workability.

The present invention was developed in view of the above problem and aims to provide a busbar capable of improving workability when the busbar is mounted on a board.

According to an aspect of this disclosure, a busbar mounted on a board and electrically connected to an external element other than the board is provided. The busbar includes a base portion; and a conductive pin body protruding from the base portion, wherein the base portion has a fixing portion where a fixing member for fixing the board and the base portion to each other is locked, and an engagement portion that extends from the fixing portion and is engaged with the board.

The foregoing and additional features and characteristics of this disclosure will become more apparent from the following detailed description considered with the reference to the accompanying drawings.

DESCRIPTION OF EMBODIMENTS

Hereinafter, an embodiment of this disclosure will be described with reference to the accompanying drawings.

Figure 1A:
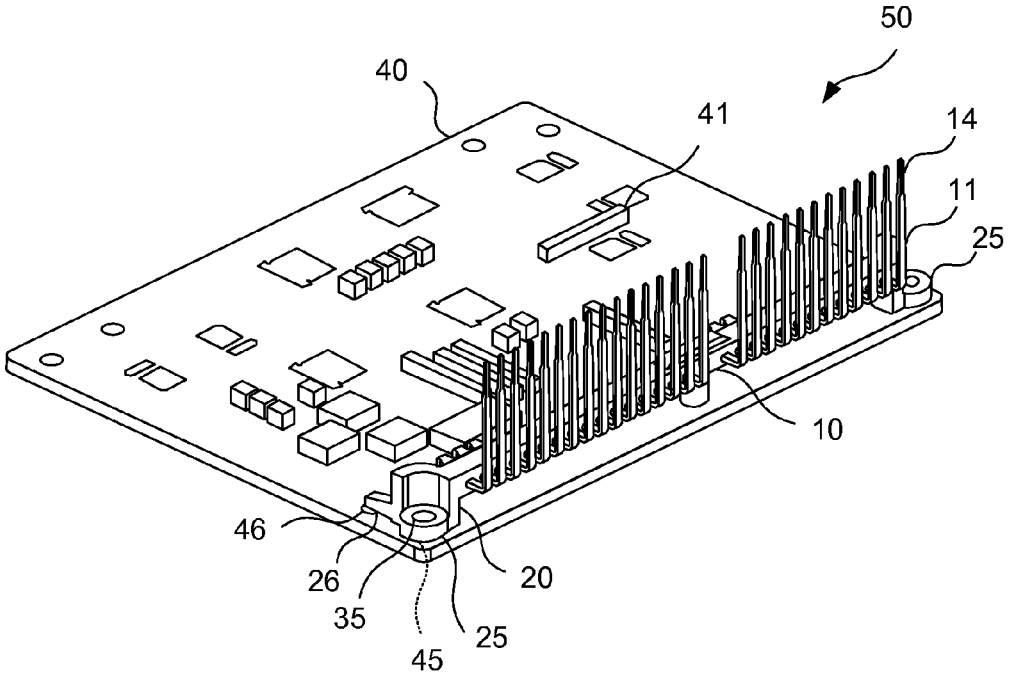
FIG. 1A is an explanatory diagram illustrating a circuit board having a busbar according to an embodiment of this disclosure.
Figure 1B:
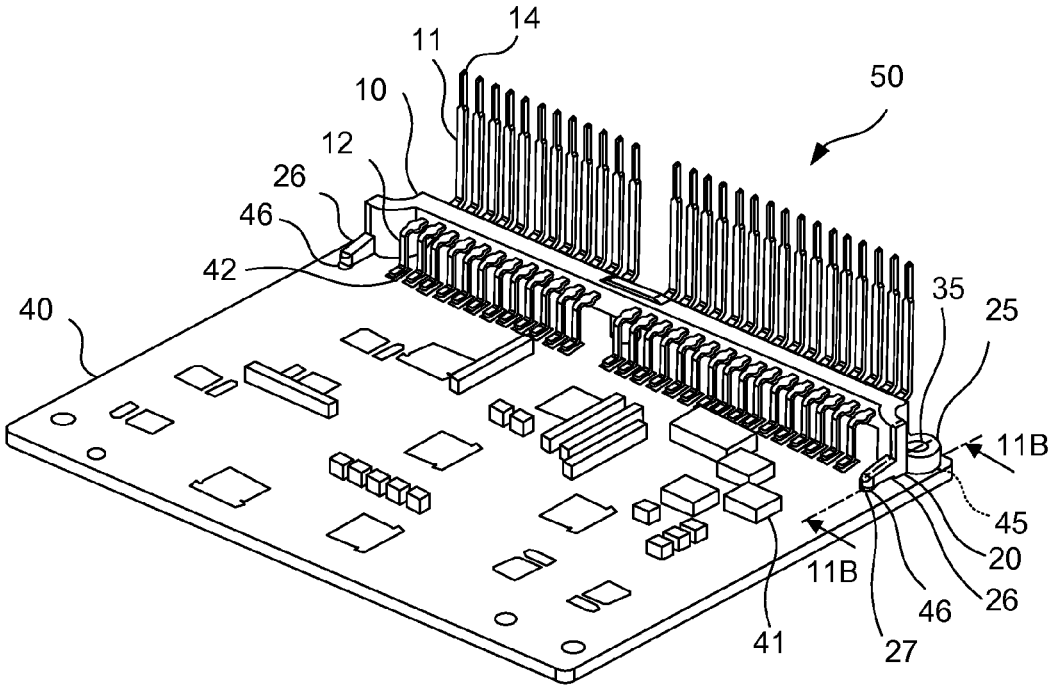
FIG. 1B is an explanatory diagram illustrating the circuit board having the busbar according to an embodiment of this disclosure.

FIGS. 1A and 1B are explanatory diagrams illustrating a circuit board 50 where a busbar 10 according to an embodiment of this disclosure is mounted. FIG. 1A is a perspective view illustrating the circuit board 50 as seen from a side where the busbar 10 is mounted. FIG. 1B is a perspective view illustrating the circuit board 50 as seen from the opposite side.

The circuit board 50 includes a board 40, a plurality of circuit components 41 mounted on the board 40, and a busbar 10.

The busbar 10 includes a plurality of busbar pins 11 extending upward perpendicularly to the board 40. When another board or functional component is arranged over the board 40, the busbar pins 11 are electrically connected to another arranged board or functional component in order to transmit or receive electric power or signals therebetween.

A plurality of busbar pins 11 of the busbar 10 are fixed to the base portion 20. The base portion 20 is formed of, for example, a non-conductive resin or the like. A plurality of busbar pins 11 are molded integratedly using the resin base portion 20 to form the busbar 10.

The busbar pins 11 are formed of a conductive metal such as copper or nickel. A surface treatment is performed on the busbar pin 11 for facilitating soldering.

The busbar pin 11 has a pin body 14 extending upward from the base portion 20 perpendicularly to the board 40 and a pin leg 12 provided to extend from the base portion 20 to the board 40 side and bonded to the board 40 through soldering.

The board 40 has a plurality of conductive lands 42 arranged in positions matching the pin legs 12. The board 40 also has fixing holes 45 perforated in positions matching the fixing portions 25 provided in both ends of the base portion 20 of the busbar 10. The board 40 also has an engagement hole 46 perforated in a position matching an engagement portion 27 protruding downward from a stand portion 26 extending from the base portion 20 to the pin leg 12 side approximately in parallel with the board 40.

The board 40 supports the busbar 10 using the fixing hole 45 and the engagement hole 46. This will be described in detail below.

Figure 2:
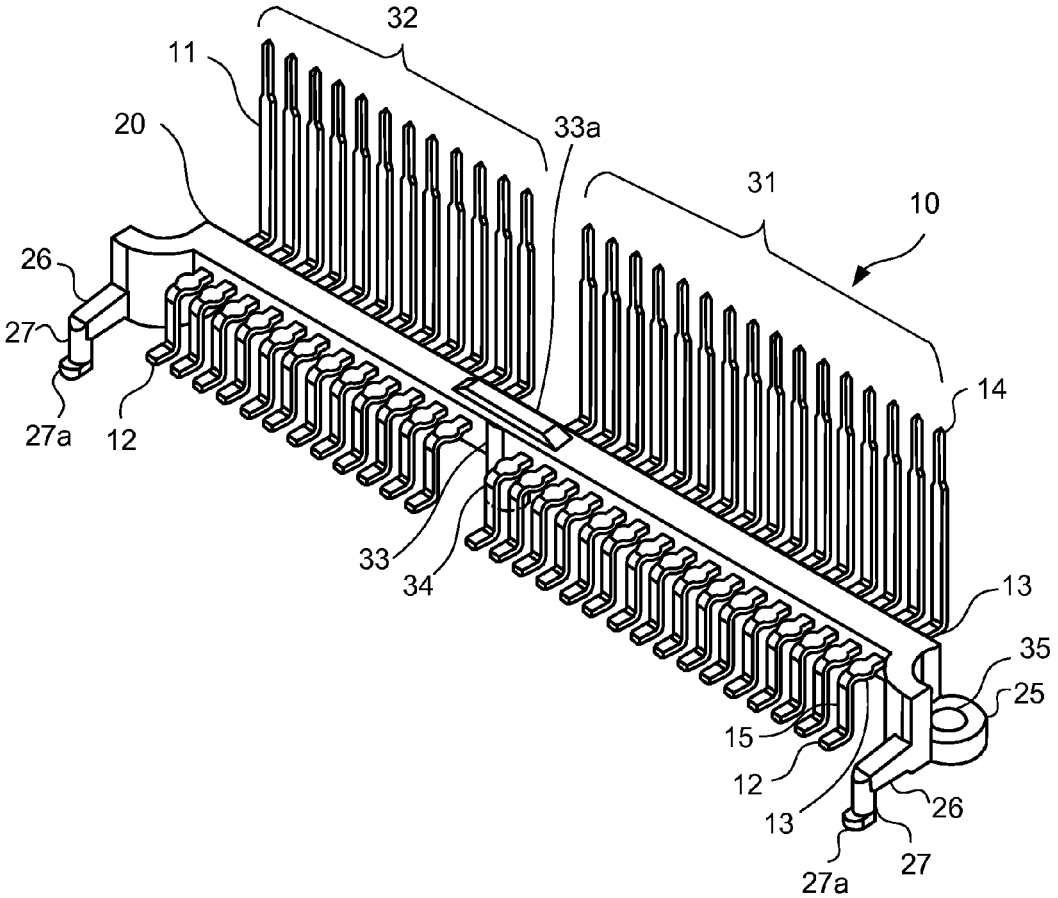
FIG. 2 is a perspective view illustrating the busbar according to an embodiment of this disclosure.

FIG. 2 is a perspective view illustrating the busbar 10 according to an embodiment of this disclosure.

The busbar 10 has a plurality of busbar pins 11 arranged with a predetermined interval in parallel. The base portion 20 is used to fix the busbar pins 11. The base portion 20 has a horizontally extending rectangular shape, and the fixing portions 25 and the stand portions 26 are formed in both longitudinal ends of the base portion 20.

The busbar 10 includes a first group 31 of sixteen busbar pins 11 and a second group 32 of twelve busbar pins 11. In the first and second groups 31 and 32, each of the busbar pins 11 is arranged with an equal interval. A center portion 33 is provided between the first and second groups 31 and 32. The center portion 33 between the first and second groups 31 and 32 has a larger interval than that of the arrangement of the busbar pins 11.

The center portion 33 has a center leg 34 extending downward to make contact with the board 40. The center leg 34 supports the busbar 10 in the center of the busbar 10 from the lower side to prevent the busbar 10 from a downward bending in the longitudinal direction, or prevent the base portion 20 from being damaged by an impact and the like. In order to prevent damage, the center portion 33 has a reinforcement 33*a* for thickening the base portion 20.

The busbar pin 11 includes a pin body 14 that protrudes upward and has a slightly tapered leading end, a crank portion 13 bent from the lower side of the pin body 14 to extend in parallel with the board 40 by a predetermined length and then bent downward to the board 40, and a pin leg 12 extending from the lower end of the crank portion 13 and having a plane approximately in parallel with the board 40.

The base portion 20 is formed of a resin and the like. The base portion 20 fixes the busbar pin 11 by molding a part of the crank portion 13 with a predetermined interval. The pin body 14 and the pin leg 12 protrude to the opposite direction to each other by interposing the base portion 20 in the crank portion 13.

The busbar pin 11 has the following characteristics due to such a configuration. First, in the base portion 20, the crank portion 13 of the pin body 14 extends in parallel with the board 40. Therefore, as the crank portion 13 is elastically deformed, the pin body 14 is also elastically deformed, so that a horizontal or vertical distortion is allowed. As a result, when the busbar pin 11 is bonded to another board or functional component, a positional deviation between the pin body 14 and the pin hole or the like is allowed due to elasticity. In addition, when a vibration or impact is applied to the circuit board 50, a stress caused by another board or functional component can be cushioned due to the elasticity.

Since the crank portion 13 of the pin leg 12 extends from the base portion 20 in parallel with the board 40, a horizontal or vertical distortion is allowed as the crank portion 13 is elastically deformed. As a result, the land 42 and the pin leg 12 are pressed by elasticity, so that the land 42 and the pin leg 12 abut on each other due to the elasticity even when a position of the pin leg 12 is slightly deviated.

The fixing portion 25 is formed in both longitudinal ends of the base portion 20. A screw hole 35 is perforated in the fixing portion 25. In the fixing portion 25, the stand portion 26 is formed to extend to the front side (toward the side where the pin leg 12 extends from the crank portion 13). An engagement portion 27 is provided in the lower side of the stand portion 26. A protrusion 27*a* protruding to the front side is provided in the lower end of the engagement portion 27.

Figure 3:
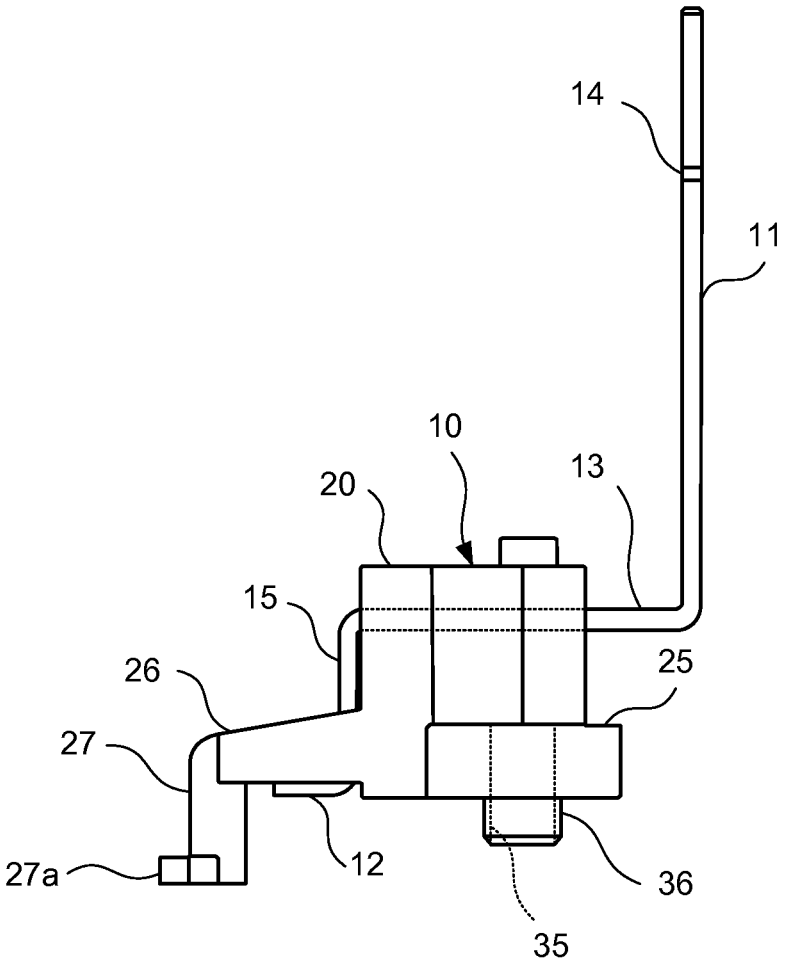
FIG. 3 is a side view illustrating the busbar according to an embodiment of this disclosure.

FIG. 3 is an explanatory diagram illustrating a side face of the busbar 10 according to an embodiment of this disclosure.

As described above, the fixing portion 25 and the stand portion 26 are formed in the base portion 20.

A screw fixing protrusion 36 protrudes in the lower side of the fixing portion 25. The screw fixing protrusion 36 protrudes to the board 40 side from the bottom of the fixing portion 25 of the base portion 20 and a screw hole 35 is perforated inside. The screw fixing protrusion 36 is inserted into the fixing hole 45 of the board 40 when the busbar 10 is mounted on the board 40.

The stand portion 26 has the engagement portion 27 and the protrusion 27*a* in its lower side. The engagement portion 27 is inserted into the engagement hole 46 of the board 40 when the busbar 10 is mounted on the board 40. When the engagement portion 27 is inserted into the engagement hole 46, the protrusion 27*a* is engaged with the front end of the bottom side of the engagement hole 46.

Figure 4:
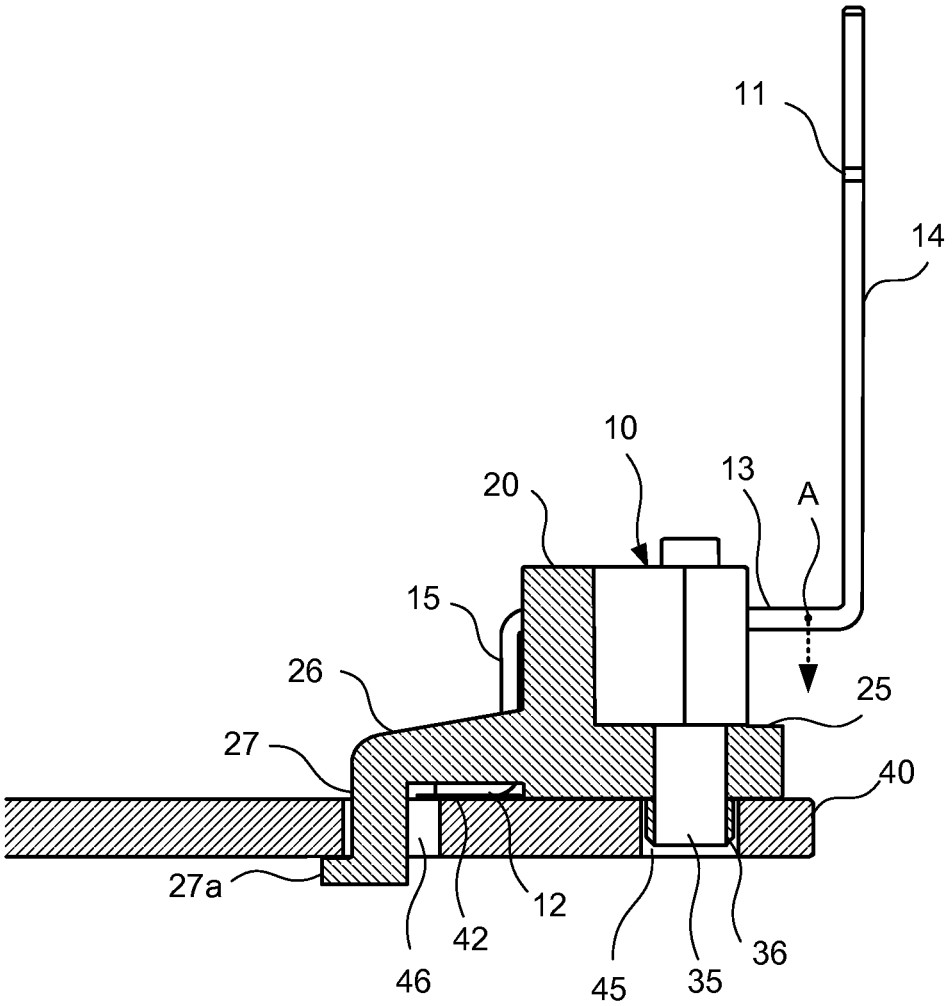
FIG. 4 is a cross-sectional view illustrating the busbar according to an embodiment of this disclosure.

FIG. 4 is a side cross-sectional view taken along the line 11B-11B of FIG. 1B when the busbar 10 according to an embodiment of this disclosure is mounted on the board 40.

When the busbar 10 is mounted on the board 40, the screw fixing protrusion 36 and the engagement portion 27 are inserted into the fixing hole 45 and the engagement hole 46, respectively, formed in the board 40.

In this case, first, the protrusion 27*a* of the engagement portion 27 is inserted into the engagement hole 46 with a slope so that the protrusion 27*a* is engaged with the bottom of the engagement hole 46. Then, the screw fixing protrusion 36 is inserted into the fixing hole 45 by pressing the busbar 10 in parallel with the board.

In this configuration, the busbar 10 is positioned on the board 40 by inserting the screw fixing protrusion 36 and the engagement portion 27 into the fixing hole 45 and the engagement hole 46, respectively. Therefore, it is possible to abuttingly fix the busbar 10 to the board 40 without performing soldering or locking a screw.

Figure 5:
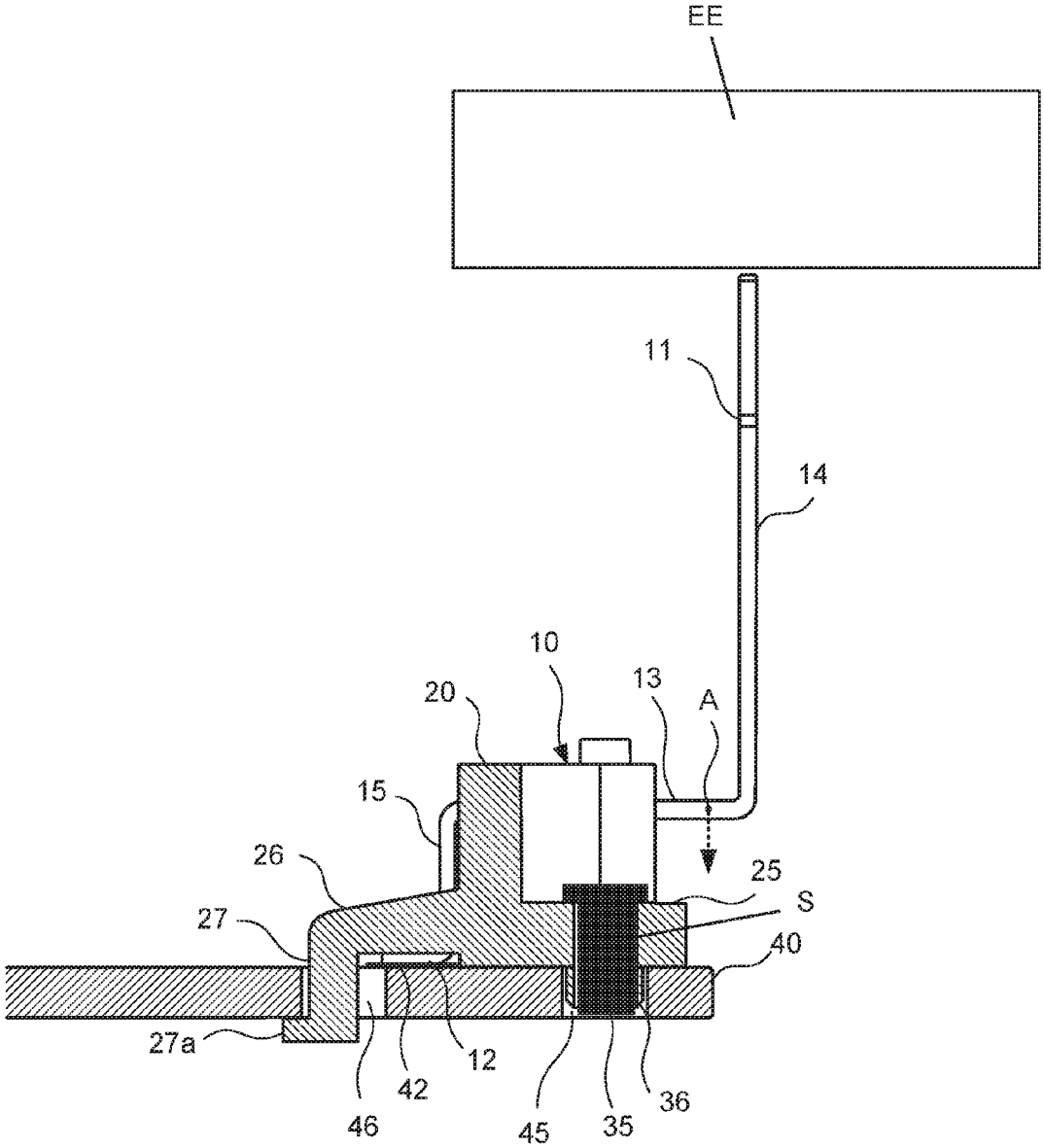
FIG. 5 is a cross-sectional view illustrating the busbar according to an embodiment of this disclosure.

As a result, the busbar 10 can be erected by itself without toppling when the busbar 10 is installed in the board 40. Therefore, it is possible to improve workability in a work for soldering the busbar pin 11 to the board 40 or a work for fixing the busbar 10 and the board 40 by locking a screw S, as illustrated in FIG. 5, in the screw fixing portion 45.

As described above, the busbar according to an embodiment of this disclosure includes the base portion 20 and the conductive pin body 14 protruding from the base portion 20, and the base portion 20 includes the fixing portion 25 where a screw S as a fixing member is locked, and the engagement portion 27 that extends from the fixing portion 25 and is engaged with the board 40 to prevent the busbar 10 from toppling.

In this configuration, it is possible to prevent the busbar 10 from toppling using the fixing portion 25 and the engagement portion 27. Therefore, it is not necessary to provide a measure for preventing the busbar 10 from toppling when the busbar 10 is mounted on the board. Accordingly, it is possible to facilitate a soldering work or a screw locking work and improve workability when the busbar 10 is mounted on the board.

Since the busbar pin 11 is made of a metallic material and is heavy, a center of the busbar 10 is positioned in the vicinity of a point A of FIG. 4, and gravity is applied downward from this point A as indicated by the dotted line of FIG. 4. In this case, since the protrusion 27*a* is engaged with the bottom side end of the engagement hole 46, the gravity of the busbar 10 is applied downward in a portion of the busbar 10 (including the pin leg 12 and the fixing portion 25) that adjoins the board 40 in the pin body 14 side from the protrusion 27*a*.

Since the gravity applied downward serves as a force of pressing the busbar 10 to the board 40, the pin leg 12 of the busbar 10 presses the land 42 of the board 40. For this reason, the pin leg 12 abuts on the land 42. Therefore, it is possible to improve workability or reliability in the soldering and prevent a failure of the soldering.

The fixing portion 25 of the busbar 10 presses the fixing hole 45 of the board 40. For this reason, the fixing portion 25 and the fixing hole 45 abut on each other. Therefore, it is possible to improve workability in a work of locking a screw S in the fixing hole 45. Moreover, as illustrated in FIG. 5, the busbar 10 is mounted on the board 40 and is electrically connected to an external element EE other than the board 40.

In the busbar 10 according to this embodiment, the portion where the busbar 10 and the board 40 abut on each other due to gravity is provided in front side of the pin body 14 (in the pin leg 12 side), and the board 40 is not necessary to exist directly under the pin body 14. Therefore, it is possible to arrange the busbar pin 11 in a lateral end of the board 40. In addition, there is no constraint in the arrangement position of the busbar pin 11, so that it is possible to improve freedom in a layout of the board 40.

Although the embodiment has been exemplarily described by assuming that the busbar pin 11 includes the pin body 14 extending upward, the crank portion 13, and the pin leg 12, the invention is not limited thereto. For example, the pin body 14 may extend from the base portion 20 in parallel with the board. The leading end of the pin body 14 may be formed in any shape (such as a flat or cylindrical shape) matching a connection target.

Although various embodiments of this disclosure have been described hereinbefore, they are just for illustrative purposes and are not intended to specifically limit the technical scope of the invention. Instead, it would be appreciated that that various changes or modifications may be possible without departing from the spirit and scope of the invention.

This application is based on and claims priority to Japanese Patent Application No. 2012-13883 filed with Japan Patent Office on Jan. 26, 2012, all the contents of which are hereby incorporated by reference.

The exclusive properties or characteristics of the embodiments of the present invention are claimed as follows.

The invention claimed is:

1. A busbar mounted on a board and electrically connected to an external element other than the board, the busbar comprising:

a base portion;

a conductive pin body protruding from the base portion in a protruding direction; and a pin leg communicating with the pin body and electrically connected to the board, wherein the base portion has a fixing portion where a fixing member fixing the board and the base portion to each other is locked, and an engagement portion extending from the fixing portion and engaging with the board, the engagement portion extending from the fixing portion in a direction opposite to the protruding direction of the pin body, the base portion fixes a busbar pin, formed by connecting the pin body and the pin leg with a crank-shaped portion, with a predetermined interval in the crank-shaped portion, the fixing portion includes a pair of fixing portions provided in longitudinal ends of the base portion, and the engagement portion extends from each of the pair of fixing portions.

2. The busbar according to claim 1, wherein the pin leg abuts on the board when the engagement portion is engaged with the board.

3. The busbar according to claim 1, wherein the pin body protrudes from the base portion in parallel with the board and is be bent in an upper direction of the base portion.

* * * * *